United States Patent [19]

Abo et al.

[11] 4,172,716

[45] Oct. 30, 1979

[54] STAINLESS STEEL HAVING EXCELLENT PITTING CORROSION RESISTANCE AND HOT WORKABILITIES

[75] Inventors: Hideo Abo; Masanori Ueda; Sakae Noguchi, all of Kitakyushu, Japan

[73] Assignee: Nippon Steel Corporation, Tokyo, Japan

[21] Appl. No.: 946,643

[22] Filed: Sep. 28, 1978

Related U.S. Application Data

[63] Continuation of Ser. No. 814,044, Jul. 8, 1977, abandoned, which is a continuation of Ser. No. 614,309, Sep. 17, 1975, abandoned, which is a continuation of Ser. No. 465,471, Apr. 30, 1974, abandoned.

[30] Foreign Application Priority Data

May 4, 1973 [JP] Japan ..... 49/49156

[51] Int. Cl.[2] ..... C22C 38/06; C22C 38/42; C22C 38/44; C22C 38/54

[52] U.S. Cl. ..... 75/124; 75/122; 75/125; 75/128 A; 75/128 C; 75/128 E; 75/128 F; 75/128 N; 75/128 G; 75/128 W

[58] Field of Search ..... 75/122, 124, 125, 128 A, 75/128 C, 128 N, 128 F, 128 G, 128 E, 128 W; 148/37, 38

[56] References Cited

U.S. PATENT DOCUMENTS

| | | | |
|---|---|---|---|
| 2,553,330 | 5/1951 | Post et al. | 75/128 E |
| 2,687,954 | 8/1954 | Lohr | 75/128 E |
| 3,551,142 | 12/1970 | De Croix | 75/128 G |
| 3,645,725 | 2/1972 | Denhard, Jr. et al. | 75/128 A |
| 3,759,757 | 9/1973 | Perry | 75/124 |
| 3,788,843 | 1/1974 | Mimino et al. | 75/124 |
| 4,108,641 | 8/1978 | Fujioka et al. | 75/122 |

*Primary Examiner*—Arthur J. Steiner

*Attorney, Agent, or Firm*—Toren, McGeady and Stanger

[57] ABSTRACT

A stainless steel having excellent pitting corrosion resistance and hot workability which comprises 0.001 to 0.20% (by weight) of C, 0.1 to 6.0% of Si, 0.1 to 10.0% of Mn, 15 to 35% of Cr, 3.5 to 35.0% of Ni, 0.01 to 6.0% of Mo ($Si+Cr+Ni+Mo \geqq 25\%$), 0.001 to 0.50% of N, 0.01 to 0.07% of Al, and 0.001 to 0.02% of Ca with the balance being iron and unavoidable impurities.

4 Claims, 1 Drawing Figure

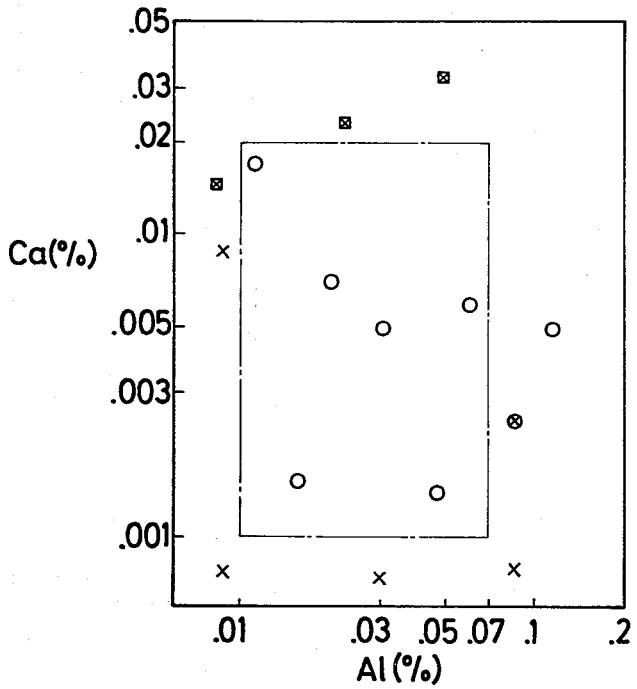
○ Good in respect of pitting corrosion resistance non-metallic inclusions, and hot workabilities
⊗ Poor pitting corrosion resistance (more than 1 g/m² hrof corrosion rate in 50 g/l $FeCl_3$+1/20 NHCl, 50°C×4hrs)
⊠ Large non-metallic inclusions (more than 10m/150cm²)
× Poor hot workabilities (cracks occur during rolling)

STAINLESS STEEL HAVING EXCELLENT PITTING CORROSION RESISTANCE AND HOT WORKABILITIES

This is a continuation of application Ser. No. 814,044, filed on July 8, 1977, now abandoned, which, in turn, was a continuation of application Ser. No. 614,309, filed on Sept. 17, 1975, now abandoned, which, in turn, was a continuation of application Ser. No. 465,471, filed on Apr. 30, 1974, now abandoned.

The present invention relates to a stainless steel having excellent pitting corrosion resistance and hot workabilities.

Stainless steels have been widely used in many fields because of their good corrosion resistance and oxidation resistance as compared with carbon steels and low-alloy steels. However, conventional stainless steels have many problems, among which localized corrosion, particularly pitting corrosion which occurs in applications in contact with media containing chlorine ion, such as, sea water is remarkable. Therefore, in recent years increasing demand has been made for stainless steels having excellent heat resistance, and oxidation resistance and various properties in addition to excellent corrosion resistance, irrespective of their applications, such as, in the oil refining industry, the atomic energy industry and the pollution preventing industry.

In order to improve various properties of the stainless steels so as to satisfy the above requirements, a large amount of a special element, such as, Mo, Ti and Nb may added to the basic composition of a stainless steel so as to obtain a high-alloy steel. But such a high-alloy steel thus obtained has a defect in that it possesses deteriorated hot workability, and hot rolling and other workings at high temperatures are difficult.

Therefore, one object of the present invention is to provide a stainless steel having excellent pitting corrosion and hot workability and yet other good properties, such as, heat resistance and high temperature strength in view of the requirements in various industries for iron-base materials.

The present inventors have conducted extensive studies with the above object in mind and have found that when Ni—Cr steels of ferrite or austenite structure or of their mixed structure contains Al and Ca, the form of inclusions is changed, the amount of large non-metallic inclusions is considerably decreased, and both pitting corrosion resistance and hot workability are improved.

The present invention is based on the above discovery, and the features of the present invention lie in a stainless steel having excellent pitting corrosion resistance and hot workability which comprises 0.001 to 0.02% (all percentages being by weight) of C, 0.1 to 6.0% of Si, 0.1 to 10% of Mn, 15 to 35% of Cr,, 3.5 to 35.0% of Ni, 0.01 to 6.0% of Mo ($Si+Cr+Ni+Mo \geqq 25\%$), 0.001 to 0.50%, of N, 0.01 to 0.07% of Al, and 0.001 to 0.02% of Ca with the balance being iron and unavoidable impurities, and may further contain optionally 0.1 to 4.0% of Cu, 0.1 to 2.0% of Nb and 0.001 to 0.20% of B alone or combination.

The present invention will be described in detail referring to the attached drawing.

FIG. 1 is a graph showing the effects of Al and Ca on pitting corrosion resistance, hot workabilities and large non-metallic inclusions of a 25% Cr-15%Ni, 1%Mo-0.25%N steel.

The reasons for limiting the amounts of component elements in the present invention will be explained hereinafter.

Carbon contents of more than 0.20% should be avoided for their adverse effect on corrosion resistance, particularly pitting corrosion. However, it is impossible to completely remove the carbon from the steel by the present steel making techniques. Therefore, the lower limit of the carbon content is set as 0.001% and the upper limit is set as 0.20%, but a lower carbon content assures better corrosion resistance, and less than 0.15% is preferable.

Silicon is added in an amount not less than 0.1% in view of the corrosion resistance and oxidation resistance. A large silicon content gives more remarkable improvements of the properties, but excessive silicon contents of over 6.0% accelerate $\sigma$ embrittlement. Therefore, the upper limit of silicon content is 6.0%.

Manganese is added in an amount not less than 0.1% to improve the hot workabilities, but manganese contents beyond 10.0% have the tendency of deteriorating the corrosion resistance. Therefore, the Mn is defined as being 0.1 to 10.0% for improving hot workabilities.

Chromium is very important for the improving corrosion resistance, particularly the pitting corrosion resistance and oxidation resistance, and less than 15% of chromium does not give satisfactory pitting corrosion or corrosion resistance. Although a greater chromium content is desirable, chromium contents beyond 35% cause $\sigma$ embrittlement and deteriorate the mechanical properties. Thus, chromium is defined as being 15 to 35%, and a preferable range is 17 to 27%.

Nickel is important for corrosion resistance and stabilization of the structure. Nickel contents less than 3.5% deteriorate the pitting corrosion resistance and other various properties. On the other hand, nickel contents beyond 35.0% tend to hinder the effects of silicon and chromium. Therefore, the nickel content is limited to the range of 3.5 to 35.0%, and pereferably is from 10 to 20%.

Nitrogen is effective for improving the corrosion resistance, particularly the pitting corrosion resistance and heat resistance, and its tangible effect is not observed when it is present in an amount less than 0.001% while its effect saturates even when it is present in an amount beyond 0.5%. Thus the nitrogen content is defined to the range from 0.001 to 0.5%, and preferably is 0.02 to 0.40%.

The addition of calcium and aluminum is one of the most important features of the present invention and they have the following effects when they are present in combination.

The attached drawings show the effects of the contents of aluminum and calcium on various properties of a 25%Cr-15%Ni-1%Mo-0.25%N steel. It is understood from the graph that calcium and aluminum, when contained in combination, are effective for improving the pitting corrosion resistance and hot workabilities and decreasing the amount of large non-metallic inclusions. However, these effects are remarkable when the aluminum content is between 0.01% and 0.07%, preferably 0.03 to 0.05%, which prevents the formation of a large amount of $Al_2O_3$ inclusions and when the calcium content is between 0.001% and 0.02%, which does not deteriorate the clearness of the steel.

In addition to the above limitations of the individual components, the total amount of silicon, chromium, nickel and molybdenum must be not less than 25% in order to improve the corrosion resistance, oxidation resistance, hot workabilities and other properties obtained by the addition of these elements so as to obtain a stable steel.

The present stainless steel within the range of the above composition shows various excellent properties, and particularly excellent pitting corrosion resistance and hot workabilities.

The present stainless steel of the above basic composition may contain one or more of 0.1 to 4.0% of Cu, and 0.1 to 2.0% of Nb for improving the corrosion resistance oxidation resistance, resistance against grain-boundary attack and oxidation resistance, and 0.001 to 0.20% of B for improving the high temperature strength. The ranges of these elements are defined because of their remarkable effects.

The stainless steel according to the present invention may be produced by an ordinary production process including melting in an ordinary melting furnace, such as, a converter and an electric furnace, and vacuum-degassing, if necessary, and simultaneous addition of aluminum and calcium to the molten steel after slug-off or to molten steel in an ingot mold, breaking-down of the ingot, hot rolling and temper treatment.

Examples of the present invention will be set forth under.

The following table shows pitting corrosion resistance and hot workabilities, etc., of the present invention steels prepared in an electric furnace in comparison with those of comparative steels. It is understood from the table that the present inventive steels show better pitting corrosion resistance and hot workabilities and yet are completely free from the large non-metallic inclusions, as compared with the comparative steels.

| | Steel Compositions (%) | | | | | | | | |
|---|---|---|---|---|---|---|---|---|---|
| Comparative steels | C | Si | Mn | Cr | Ni | Mo | N | Al | Ca |
| 1 | 0.05 | 0.60 | 1.01 | 17.2 | 12.9 | 2.5 | 0.02 | 0.011 | 0.0005 |
| 2 | 0.04 | 0.63 | 1.22 | 25.1 | 5.8 | 1.8 | 0.06 | 0.022 | 0.0005 |
| 3 | 0.11 | 0.72 | 1.55 | 25.4 | 21.3 | — | 0.05 | 0.004 | 0.0005 |
| 4 | 0.06 | 0.66 | 1.21 | 24.3 | 13.2 | 0.7 | 0.30 | 0.021 | 0.0007 |
| 5 | 0.04 | 0.70 | 1.46 | 24.8 | 13.3 | 0.9 | 0.18 | 0.009 | 0.0008 |
| 6 | 0.03 | 0.88 | 1.44 | 20.4 | 31.4 | 2.2 | 0.02 | 0.030 | 0.0005 |
| Inventive steels | | | | | | | | | |
| 7 | 0.04 | 0.81 | 1.02 | 17.3 | 13.3 | 2.3 | 0.02 | 0.051 | 0.0044 |
| 8 | 0.03 | 0.41 | 1.51 | 25.2 | 6.8 | 1.6 | 0.06 | 0.033 | 0.0021 |
| 9 | 0.16 | 0.90 | 1.51 | 23.1 | 13.4 | 0.001 | 0.02 | 0.031 | 0.0110 |
| 10 | 0.14 | 0.90 | 2.20 | 25.2 | 21.1 | 0.02 | 0.03 | 0.016 | 0.0090 |
| 11 | 0.03 | 3.11 | 4.40 | 16.6 | 14.1 | 0.7 | 0.03 | 0.022 | 0.0130 |
| 12 | 0.02 | 0.88 | 1.53 | 24.8 | 13.2 | 0.8 | 0.33 | 0.044 | 0.0080 |
| 13 | 0.04 | 0.72 | 1.08 | 23.2 | 13.6 | 1.2 | 0.28 | 0.030 | 0.0044 |
| 14 | 0.01 | 0.66 | 1.16 | 22.1 | 14.4 | 1.0 | 0.40 | 0.018 | 0.0021 |
| 15 | 0.06 | 0.61 | 1.55 | 16.3 | 16.1 | 5.0 | 0.03 | 0.019 | 0.0035 |
| 16 | 0.05 | 0.15 | 1.55 | 20.2 | 31.0 | 2.2 | 0.03 | 0.040 | 0.0060 |
| 17 | 0.15 | 1.3 | 0.9 | 23.1 | 13.0 | 0.02 | 0.32 | 0.031 | 0.005 |
| 18 | 0.06 | 0.8 | 1.1 | 17.1 | 14.0 | 2.2 | 0.03 | 0.020 | 0.0033 |

| | Steel Compositions (%) | | | Test Results | | | |
|---|---|---|---|---|---|---|---|
| | Cu | No | B | (a)Pitting corrosion resistance | (b)Large non-metallic inclusion | (c)Hot workabilities | Tensile strength at 800° C. kg/cm² |
| 1 | 0.1 | — | — | × | O | ○ | 24 |
| 2 | — | — | — | Δ | Δ | × | 15 |
| 3 | — | 0.022 | — | × | × | Δ | 26 |
| 4 | — | — | — | O | Δ | × | 31 |
| 5 | — | — | — | O | Δ | Δ | 28 |
| 6 | 3.11 | — | — | ○ | O | × | 27 |
| 7 | — | — | — | Δ | O | ○ | 25 |
| 8 | 2.1 | — | — | O | O | O | 15 |
| 9 | — | — | — | Δ | O | O | 26 |
| 10 | — | — | — | Δ | O | ○ | 25 |
| 11 | 0.6 | 0.50 | — | Δ | O | ○ | 24 |
| 12 | — | — | — | ○ | O | ○ | 33 |
| 13 | — | 0.31 | — | ○ | O | ○ | 32 |
| 14 | — | — | — | ○ | O | ○ | 34 |
| 15 | — | — | — | ○ | O | O | 33 |
| 16 | 3.3 | — | — | ○ | O | O | 27 |
| 17 | | | 0.008 | — | O | ○ | 34 |
| 18 | 0.31 | | | O | O | ○ | 29 |

(a)Pitting corrosion resistance: tested in 50g/l $FeCl_3$ + 1/20NHCl, 50° C., 48 hrs. × = 10g/cm²hr or more Δ = 3 − 8g/cm²hr, O = 1 − 3g/cm²hr, ○ = less than 1 g/cm²hr (b)Large non-metallic inclusion: Estimated by the total length per 150 cm², × = more than 30mm Δ = 10 − 30mm, O = less than 10 mm (c)Hot workabilities; × = large crack, Δ = edge crack O = partial small edge crack, ○ = no crack

What is claimed is:

1. A stainless steel having excellent pitting corrosion resistance and hot workability consisting of 0.001 to 0.20% (by weight) of C, 0.1 to 6.0% of Si, 0.1 to 10.0% of Mn, 17 to 27% of Cr, 10.0 to 20.0% of Ni, 0.01 to 6.0% of Mo (Si+Cr+Ni+Mo≧25%), 0.001 to 0.50% of N, 0.01 to 0.07% of Al, and 0.001 to 0.02% of Ca with the balance being iron and unavoidable impurities.

2. A stainless steel having excellent pitting corrosion resistance and hot workability, consisting of 0.001 to 0.20% of C, 0.1 to 6.0% of Si, 0.1 to 10.0% of Mn, 17 to 27% of Cr 10.0 to 20.0% of Ni, 0.01 to 6.0% of Mo (Si+Cr+Ni+Mo≧25%), 0.001 to 0.50% of N, 0.01 to 0.07% of Al, 0.001 to 0.02% of Ca, and one or two of 0.1 to 4.0% of Cu, and 0.1 to 2.0% of Nb, with the balance being iron and unavoidable impurities.

3. A stainless steel having excellent pitting corrosion resistance and hot workabilities, consisting of 0.001 to 0.20% of C, 0.1 to 6.0% of Si, 0.1 to 10.0% Mn, 17 to 27% of Cr, 10.0 to 20.0% of Ni, 0.01 to 6.0% of Mo, (Si+Cr+Ni+Mo≧25%), 0.001 to 0.50% of N, 0.01 to 0.07% of Al, 0.001 to 0.02% of Ca and 0.001 to 0.2% of B with the balance being iron and unavoidable impurities.

4. A stainless steel having excellent pitting corrosion resistance and hot workabilities consisting of 0.001 to 0.20% of C, 0.1 to 6.0% of Si, 0.1 to 10.0% Mn, 17 to 27% of Cr, 10.0 to 20.0% of Ni, 0.01 to 6.0% of Mo, (Si+Cr+Ni+Mo≧25%), 0.001 to 0.50% of N, 0.01 to 0.07% of Al, 0.001 to 0.02% of Ca, 0.001 to 0.2% of B, and one or two of 0.1 to 4.0% of Cu, and 0.1 to 2.0% of Nb with the balance being iron and unavoidable impurities.

* * * * *